US005358467A

United States Patent [19]

Milstein et al.

[11] Patent Number: 5,358,467

[45] Date of Patent: Oct. 25, 1994

[54] METHOD FOR VACUUM MECHANOTHERMAL STIMULATION OF THE BODY SURFACE

[76] Inventors: Anatole Milstein, 3 Covered Bridge Path; Arkady Relin, 2301 Woodward St., Apt. A-14, both of Philadelphia, Pa. 19115

[21] Appl. No.: 40,832

[22] Filed: Mar. 31, 1993

Related U.S. Application Data

[63] Continuation-in-part of Ser. No. 700,265, May 5, 1991, abandoned.

[51] Int. Cl.[5] ..... A61H 1/00

[52] U.S. Cl. ..... 601/10; 601/9; 601/16; 601/134

[58] Field of Search ..... 601/6–16, 601/134

[56] References Cited

U.S. PATENT DOCUMENTS

| | | | |
|---|---|---|---|
| 1,399,095 | 12/1919 | Webb | 128/38 |
| 2,571,398 | 10/1951 | Wheeler | 128/38 |
| 2,655,145 | 10/1953 | Heger | 128/24.1 |
| 2,739,586 | 4/1954 | Preis | 128/24.1 |
| 2,832,336 | 6/1955 | Davis | 128/24.1 |
| 4,428,368 | 1/1984 | Torii | 128/38 |
| 5,074,285 | 12/1991 | Wright | 128/40 |

*Primary Examiner*—Robert A. Hafer

*Assistant Examiner*—David J. Kenealy

*Attorney, Agent, or Firm*—I. Zborovsky

[57] ABSTRACT

A method of stimulation of a body surface with application of a fluid matter pressure over a part of the body surface, a mechanical pressure on local points of the body surface, and a temperature change of the part of the body surface, the method comprises the steps of applying a negative fluid matter pressure over the whole part of the body surface; increasing the mechanical pressure on the local points distributed over the whole part of the body surface simultaneously with the applying the negative fluid matter pressure; cooling the part of the body surface simultaneously with the applying the negative fluid matter pressure and increasing the mechanical pressure on the local points; maintaining said negative fluid matter pressure, said increased mechanical pressure on the local points and said cooling over a preset period of time; then raising the pressure of the fluid matter over the whole part of the body surface; reducing the mechanical pressure on the local points of the part of the body surface simultaneously with said raising the pressure of the fluid matter; warming the part of the body surface simultaneously with said raising the pressure of the fluid matter and reducing the mechanical pressure; and maintaining said raised pressure of the fluid matter, said reduced mechanical pressure, and said cooling over a preset period of time.

2 Claims, 2 Drawing Sheets

METHOD FOR VACUUM MECHANOTHERMAL STIMULATION OF THE BODY SURFACE

CROSS REFERENCE TO A RELATED APPLICATION

This application is a continuation of U.S. patent application Ser. No. 07/700,265, filed on May 5, 1991, for METHOD FOR MECHANOTHERMAL STIMULATION OF THE BODY SURFACE, inventors Anatole Milsrein and Arkadi Relin, NOW ABANDONED.

BACKGROUND OF THE INVENTION

The present invention relates to the field of stimulation of a human body.

Methods and devices are known for stimulating of a human body by means of periodical pressing action on its local parts with different mechanical, hydraulic, vibrating and other devices. The pressing action provides better blood circulation in a zone of action but is often accompanied with pain because of local pressure on bones. This negative effect is especially strong in zones where the underskin fat and/or muscle layer is thin. Regular stimulating methods also in many cases cannot be used in the zones which are traumatized and/or cover traumatized organs (such as broken bones, bruises, recently operated tissues, etc.).

SUMMARY OF THE INVENTION

It is the object of the present invention to increase the efficiency of the body surface stimulation. It is another object of this invention to widen the number of cases when the stimulation by applying of pressing action can be used.

These and other objects are achieved by a new method of stimulation, consisting of combination of sequent-simultaneous vacuum mechanothermal actions on the surface of a human body.

The inventive method comprises a method of stimulation of a body surface with application of a fluid matter pressure over a part of the body surface, a mechanical pressure on local points of the body surface, and a temperature change of the part of the body surface, the method comprises the steps of applying a negative fluid matter pressure over the whole part of the body surface; increasing the mechanical pressure on the local points distributed over the whole part of the body surface simultaneously with the applying the negative fluid matter pressure; cooling the part of the body surface simultaneously with the applying the negative fluid matter pressure and increasing the mechanical pressure on the local points; maintaining said negative fluid matter pressure, said increased mechanical pressure on the local points and said cooling over a preset period of time; then raising the pressure of the fluid matter over the whole part of the body surface; reducing the mechanical pressure on the local points of the part of the body surface simultaneously with said raising the pressure of the fluid matter; warming the part of the body surface simultaneously with said raising the pressure of the fluid matter and reducing the mechanical pressure; and maintaining said raised pressure of the fluid matter, said reduced mechanical pressure, and said cooling over a preset period of time.

Choosing the type of fluid matter, the preset character of the variation of the fluid matter pressure, the preset character of the variation of the mechanical pressure, and the preset character of the variation of the regimes of cooling and warming within the cycle, depends on mechanical and physiological properties of the part of the body surface to be stimulated.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF A PREFERRED EMBODIMENT

Figure 1:
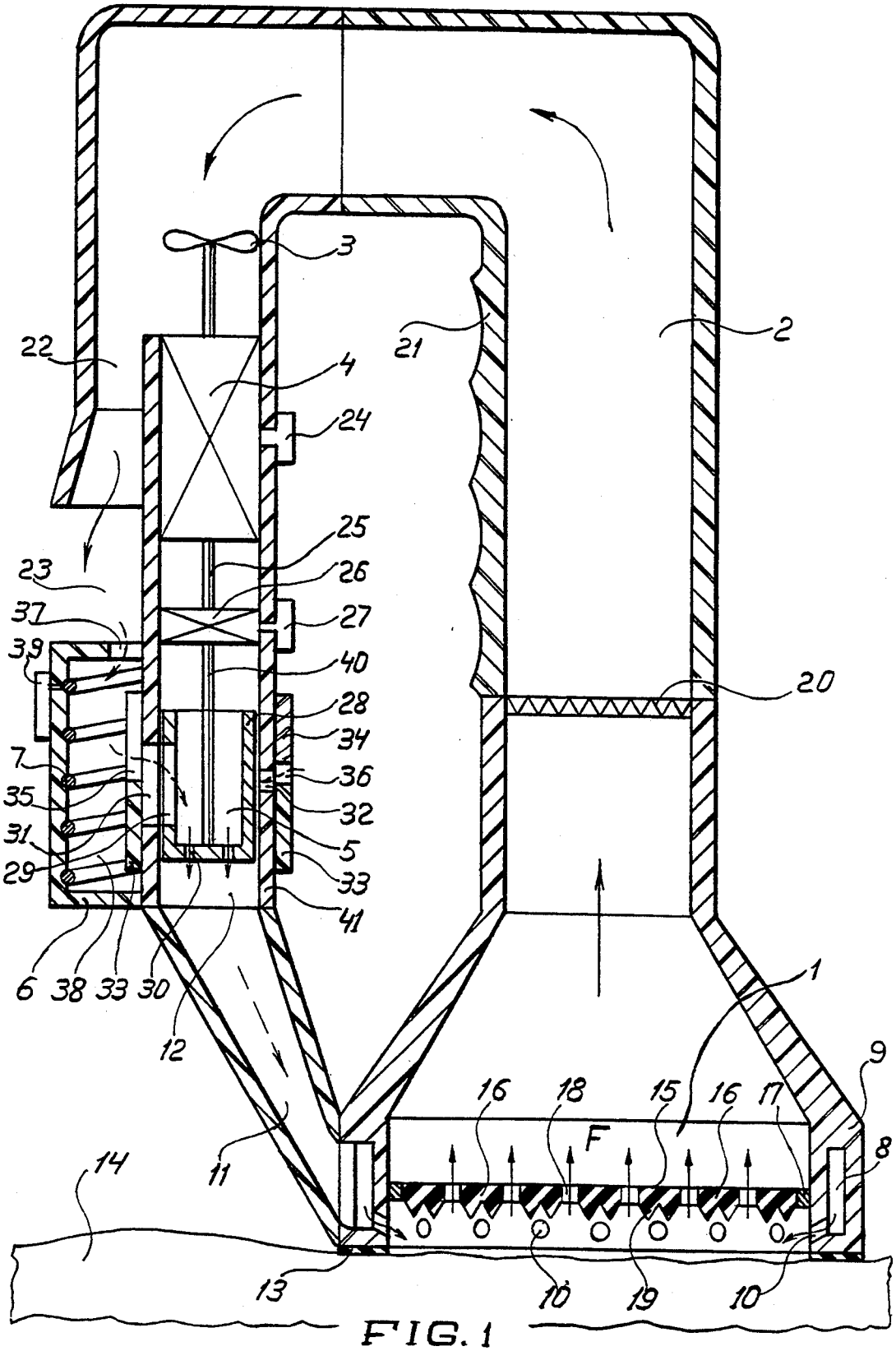
FIG. 1 is a schematic illustration of an example of a device for performing a method in accordance with the present invention.

A stimulator shown on FIG. 1 is an example of a possible device for performing the inventive method of the vacuum mechanothermal stimulation of the body surface. The stimulator has a suction head 1, a suction line 2, a source of suction force 3 with a motor 4, a modulator of a suction force 5, and a chamber for air heating 6 with a heater 7. The suction head 1 has a closed channel 8 in its housing 9, and passages 10 connecting the interior of the suction head 1 along its all perimeter with the channel 8. The openings of the passages 10 are located near the bottom of the suction head 1. The channel 8 is connected through a channel 11 with an entrance 12 of the modulator 5. The bottom surface of the suction head 1 has an elastic pad 13. This pad has a direct contact with a human body 14 in a process of stimulation.

The suction head 1 accommodates an elastic membrane 15 covering all area of its cross-section. The membrane 15 is positioned within the preset distance (tenths-hundredths of an inch) from the bottom surface of the suction head 1. This distance is adjustable depending on a specific part of the body being stimulated and on desired strength of the stimulation. An elastic part 16 of the membrane 15 can be made of rubber or another elastic material and attached to a rigid frame 17 fixed on the internal surface of the suction head 1 (for example by means of thread joint). The elastic part 16 of the membrane 15 has through holes 18 and bumps 19 located between the holes 18 and facing the body surface 14. The bumps 19 are distributed over the same surface 16 and located between the holes 18. The stimulator can be supplied with a set of different membranes each having its own pattern and number of bumps 19 of different shape (for example sharp or dull), and also holes in different locations and of different diameters and numbers. Selection of specific membrane by a user depends on desired strength of the stimulation and on the part of the body to be stimulated. A removable filter 20 is located in the suction line 2. It serves for cleaning air from possible moisture and dirt taken from the body surface 14 in the process of stimulation. A part of the external surface of the stimulator's housing is designed as a handle 21.

The suction line 2 becomes a pumping line 22 below the source of suction 3. It opens into the environment at a zone 23. The motor 4 has a velocity switch 24. A shaft 25 connects the motor 4 with a speed variator 26 of the suction force modulator 5. The speed variator 26 is connected with a flow interrupter 28 by a shaft 40. The interrupter 28 has a longitudinal window 29 i its side and a number of holes 30 in its bottom. A housing 41 of the modulator 5 has a high transversal slot 31 and a narrow transversal slot 32. The slots 31 and 32 are provided with adjustors of their dimensions 33 and 34. Change of the heights of the slots 312 and 32 is performed by sliding of the adjustors 33 and 34 along the housing 41 of the modulator 5. Changing of the length of the slots 31 and 32 is performed by turning the adjustor 34 around the housing 41 of the modulator 5. This changes the length of those parts of the slots 31 and 32 which coincide respectively with slots 35 and 36 of the adjustor 34.

The chamber 6 for air heating has an opening 37 connecting its interior 38 with the zone 23 of the environment. The heater 7 positioned inside of the chamber 6, has a thermostat 39. The motor 4 and the thermostat 39 are connected with the source of electric energy (not shown on the Figure).

The inventive method is performed in the following way.

When the motor 4 is turned on, the source of suction force 3 and the modulator 5 starts working. The working source of suction force 3 creates the negative air pressure over the body surface 14 under the suction head 1. Under the action of the increasing (from $F_{min}$) suction force F the body surface 14 moves into the direction of the membrane 15. At the moment when the body surface 14 touches the tips of the bumps 19, the pressure action on the local points of the body surface 14 starts increasing. Being intaken further, the body surface bends the elastic part 16 of the membrane 15, experiencing the increasing pressing action. At the same time the angles of application of pressing forces are changing continuously. The body surface stops bending the flexible part 16 of the membrane 15 when the resistance force of the membrane is equalized by the suction force at its maximum value ($F_{max}$).

Figure 2:
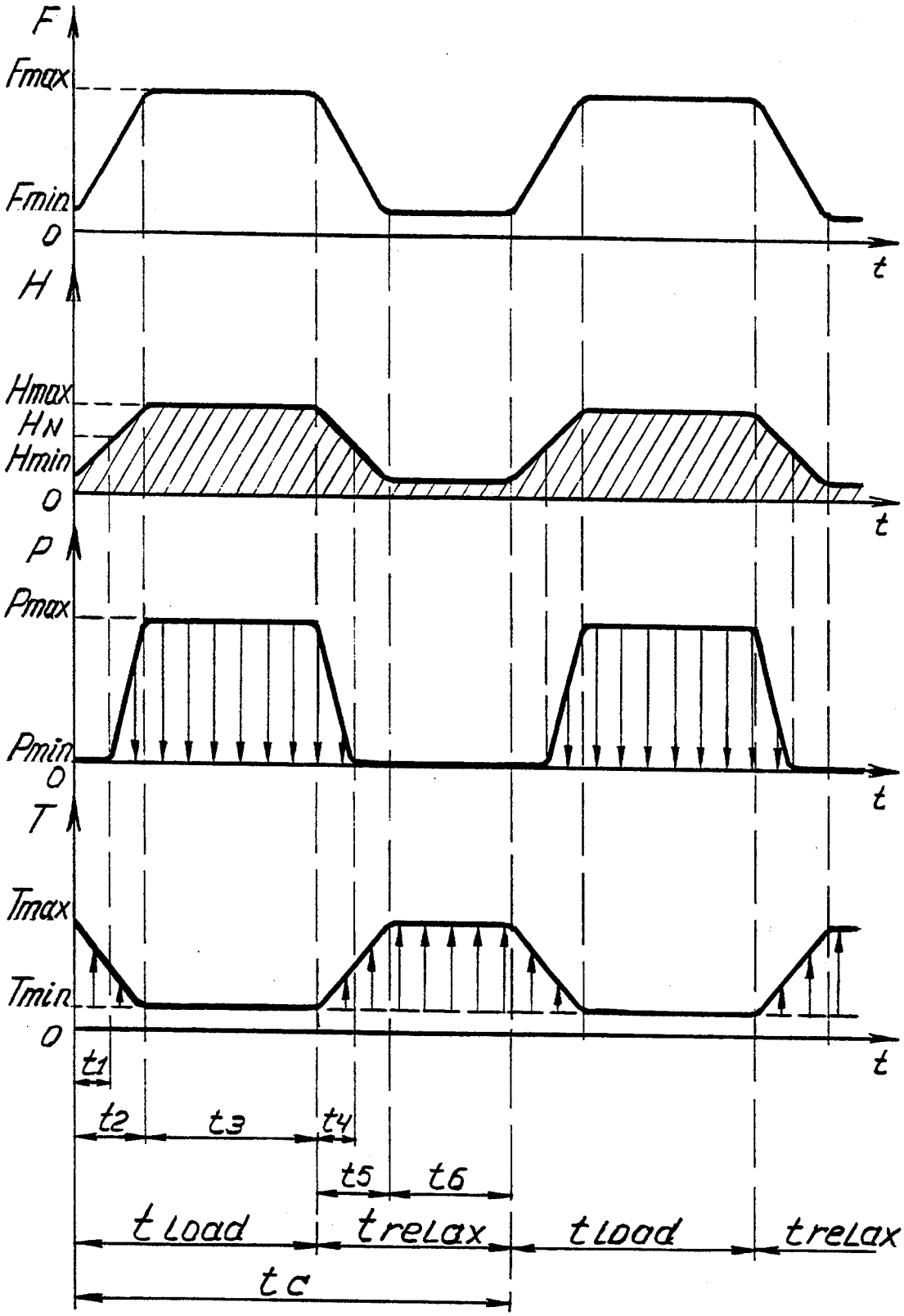
FIG. 2 is a graphic illustration of the components of a cycle in accordance with the inventive method.

The increase of the suction force from $F_{min}$ to $F_{max}$ continues during the period time $t_2$ (see FIG. 2). It takes place due to the rotation of the breaker 28 of the modulator 5. When the breaker 28 rotates its window 29 moves from the slot 31 to the slot 32. As a result of this motion of the window 29 of the the way for hot air flow is interrupted. This hot air has been traveling from the interior of the chamber 6 through the slot 35 of the regulator 34, slot 31, the window 29, the interior of the breaker 28 and its holes 30, the entrance 12 of the modulator 5. Further this air flow has been traveling through the channel 11 to the channel 8 of the suction head 1 and through its holes 10 has been entering suction force 1 and through its holes 10 has been entering the interior of the suction head 2.

When the described air flow was being formed, the suction force was $F_{min}$, and the body surface 14 was slightly intaken inside of the suction head 1 on the extension of $h_{min}$ (actually hundredth of an inch). Hot air flow having preset temperature $T_{max}$ was coming onto the body surface 14 from the chamber 6. This air, due to the action of force $F_{min}$, was dumped into the environment of the zone 23 after passing through the holes 18 of the membrane, filter 20, suction line 2, and pumping line 22. Simultaneously, after passing over the slot 31, the window 29 starts passing along the slot 32. At this moment the incoming of the hot air stops and the incoming of the cold air flow with the room temperature $T_{min}$ begins. This cold air travels by the same way onto the body surface 14 with the difference that it flows through the slot 36 of the adjustor 34 and through the slot 32 of the housing 41 of the modulator 5. Incoming of this airflow into the zone of the stimulation and reaching at the same time of the maximum of the suction force ($F_{max}$) provides reduction of the temperature of the body surface 14. When the suction force equals $F_{max}$ the body surface 14 occupies the position $h_{max}$ (see FIG. 2). After period of time $t_1$ when body surface is intaken inside of the suction head 1 on the magnitude $h_N$, the mechanical pressure action provided by the bumps 19 begins. It starts with pressure $P_{min}=0$. This pressure action reaches its maximum ($P_{max}$) after period of time $t_2$ during the process of change of the position h of the body surface 14 and change of temperature T of the air flow.

During the period of time $t_3$ the window 29, while moving, passes along the slot 32. During this time both the created negative pressure (corresponding to the suction force $F_{max}$) above the body surface 14 and the reached value of the mechanical pressure ($O_{max}$) of the bumps 19 applied to the local points of this surface are being maintained. During time period $t_3$ the body surface is still in the position $h_{max}$ and is stimulated by the action of the air flow with the temperature $T_{min}$ coming onto this surface.

Thus, during the time periods $t_1$, $t_2$ and $t_3$ the operations are performed corresponding to the steps a, b, c and d of the inventive method of the stimulation. During all this period of "loading time $t_{load}=t_2+t_3$ the part of the body surface 14 is being stimulated by a combination of the following actions:

vacuum stimulation, since the body surface 14 is forced to move under the suction head 1;

mechanical stimulation, due to motion of the part of the body surface 14 against the pressure action of the bumps 19;

thermal stimulation, as a result of fast decrease of the temperature of the body surface by the action of relatively cool air and by heat removal as a result of the suction force action; these actions cause narrowing of the surface blood vessels.

Since these stimulations take place sequently-simultaneously the combining effect of the all three strengthens.

After period of time $t_3$ ends the window 29 leaves behind the slot 32 and again starts passing along the slot 31. This starts increasing the cross-section of the passage (consisting of listed above slots, holes and channels) which connects the interior of the suction head 1 with the environment. The negative air pressure under the suction head 1 decreases respectively, and the suction force is reduced to the value $F_{min}$ after the period of time $t_5$ . The body surface 14 changes its position from $h_{max}$ to $h_{min}$ (see FIG. 2). At the same time the mechanical pressure on local points of the body surface 14 decreases with simultaneous change of the angles of applications of the pressing forces. The change of the angles takes place because of the return of the bumps 19 in their initial position. After the preset period of time $t_4$ passing from the moment when the suction force F starts decreasing, the body surface reaches the position $h_N$ and its contact with the bumps 19 stops. From this moment the magnitude of the pressing action becomes equal $P_{min}=0$. Simultaneously, during time $t_5$ the body surface undergoes of the warming action of hot air flow with preset temperature $T_{max}$, for example up to 250 ° C. This air flow comes from the chamber 6 (connected with the environment through the opening 37) through the modulator 5, channels 11, 8 and holes 10, and reaches the body surface 14. During the preset period of time $t_6$ the window 29 in the process of its motion passes along the slot 31, and therefore the reached maximum of the negative pressure (suction force is equal $F_{min}$) is being maintained over the body surface 14. Simultaneously, the process of warming of the body surface with the hot air flow having the preset temperature $T_{max}$, continues until the total cycle of action with the period of time $t_6$ ends.

Thus, during the periods of time $t_4$, $t_5$ and $t_6$ the operations are performed corresponding to the steps e, f, g and h of the inventive method of the stimulation. During all this time period ($t_{relax}=t_5+t_6$) the combination of relaxing actions is provided as follows:

stopping of vacuum stimulation, and therefore decreasing of stretching forces in the body surface;

decreasing up to zero the pressing action of the membrane bumps 19 on the local points of the body surface;

increasing of the thermal action causing widening of surface vessels and opening of pores.

Sequent-simultaneous actions of these steps provides high efficiency of the process of relaxation of the body surface in the stimulated zone during this part of the cycle.

Since the interrupter 28 of the modulator 5 rotates continuously, the full "load/relaxation" cycle repeats again and again. The frequency of these cycles can be up to 20 Hz. The desirable frequency is preset by means of the regulator 26 with the switch 27. Time periods of the described steps of the stimulation are chosen depending on the specifics of the parts of the body being stimulated and on maximal desirable effect of the stimulation. In the given example of the device using the presented method, the time periods $t_2$ and $t_5$ can be preset by adjusting the speed of rotation of the interrupter 28 and on the active width of the window 29. The time periods $t_3$ and $t_6$ are preset by adjusting also the rotation speed of the interrupter 28 and the length of the slots 32 and 31. The time periods $t_1$ and $t_4$ (which are only a few percents of t) depend on the magnitude of $h_N$ corresponding to the position of the tips of the bumps 19 in reference to the initial position of the body surface 14. They also depend on the speed of intaking of the body surface inside of the suction head 1 by the suction force F.

The suction force F depends on rotation speed of its source 3 which can be adjusted with the speed regulator 24 of the motor 4. Besides, the values of the suction force ($F_{min}$ and $F_{max}$) in the zone of the stimulation depend on the position of the regulator 33, which changes the heights of the slots 31 and 32, and therefore the cross-section of the air flow.

The motion of the stimulator along the body can be performed by hand by the handle 21.

The different systems of the stimulators can be used utilizing the suggested method. For example, the more powerful source of suction can be made as a separate block which is connected with the suction head by means of a flexible hose.

The profile of the bottom of the suction head 1 contacting the body surface can be selected taking into account an area, shape and elasticity of the body part to be stimulated. Possible maximum of the suction force $F_{max}$ provided by the device must also be taken into account.

The suction force modulation periodical character can be chosen as sinusoidal, triangular, rectangular and so on, depending on the purpose of the stimulation. The chosen modulation character is achieved by corresponding selection of the shape of the window 29 and the slots 31, 32, 35 and 36.

The new method of the stimulation gives the opportunity to create the variety of different devices for vacuum mechanothermal stimulation of practically all parts of the body surface. The possibility to use changeable membranes with different bumps, holes and elasticity permits to have desirable character of the vacuum action and mechanical pressure on the body surface. The new method provides the new possibility to get pressing action on the body surface when it is elevated from its original position. This eliminates pain which takes place when the conventional method are used. The new method gives the opportunity to stimulate the body in the zones of broken bones, contusions, inflammations, hematomas, etc. The combination of pressing action with periodical thermal action increases significantly the efficiency and the pleasure of the procedure. In addition, the vacuuming action takes place which provides cleaning of pores and improve the elasticity of the body surface. The suggested new method widens significantly the opportunities of the body stimulation.

We claim:

1. A method of stimulation of a body using a massage device that comprises a housing containing pressure means, an inlet for negative pressure with a plurality of projections located in a region of the inlet, and means for cooling and heating the user, the method comprising the steps of:

1) applying the housing inlet to a user and applying a negative pressure over a whole part of a body surface;
2) simultaneously with step 1) increasing mechanical pressure on local points distributed over the whole part of the body surface by acting on the local points with the plurality of projections;
3) simultaneously with steps 1) and 2) using the massage device to cool the part of the body surface by interrupting a supply of a fluid matter to the inlet which has been previously heated by the cooling and heating means;
4) maintaining said steps 1), 2), 3), over a preset period of time;
5) reducing the negative pressure over the whole part of the body surface;
6) simultaneously with step 5) reducing the mechanical pressure on the local points over part of the body surface;
7) simultaneously with steps 5) and 6), warming the part of the body surface by supplying the fluid matter which has been previously heated by the cooling and heating means to the inlet; and
8) maintaining the steps 5), 6), and 7) over a preset period of time.

2. A method as defined in claim 1; and further comprising the step of repeating steps 1)–8) with a frequency of up to 20 Hertz.

* * * * *